US008629633B2

(12) United States Patent
Heid et al.

(10) Patent No.: US 8,629,633 B2
(45) **Date of Patent: *Jan. 14, 2014**

(54) DC HIGH VOLTAGE SOURCE AND PARTICLE ACCELERATOR

(75) Inventors: Oliver Heid, Erlangen (DE); Timothy Hughes, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 7 days.

This patent is subject to a terminal disclaimer.

(21) Appl. No.: 13/581,283

(22) PCT Filed: Feb. 2, 2011

(86) PCT No.: PCT/EP2011/051463

§ 371 (c)(1),
(2), (4) Date: Aug. 24, 2012

(87) PCT Pub. No.: WO2011/104078

PCT Pub. Date: Sep. 1, 2011

(65) Prior Publication Data

US 2012/0319624 A1 Dec. 20, 2012

(30) Foreign Application Priority Data

Feb. 24, 2010 (DE) ..... 10 2010 008 992

(51) Int. Cl.
*H05H 5/00* (2006.01)

(52) U.S. Cl.
USPC ..... 315/506; 315/500; 315/501; 315/502; 315/503; 315/504; 315/505

(58) Field of Classification Search
USPC ..... 315/500–506; 363/61
See application file for complete search history.

(56) References Cited

U.S. PATENT DOCUMENTS 2,887,599 A 5/1959 Trump ..... 313/74
4,092,712 A * 5/1978 Harrigill et al. ..... 363/60

(Continued)

FOREIGN PATENT DOCUMENTS

DE 976500 C 10/1963 ..... H05H 21/36
DE 2128254 1/1974 ..... H01J 33/00

(Continued)

OTHER PUBLICATIONS

International PCT Search Report and Written Opinion, PCT/EP2011/051468, 14 pages, Feb. 2, 2011.

(Continued)

*Primary Examiner* — Daniel Cavallari
*Assistant Examiner* — Srinivas Sathiraju
(74) *Attorney, Agent, or Firm* — King & Spalding L.L.P.

(57) ABSTRACT

A DC high voltage source may include: (a) a capacitor stack having a first electrode which can be brought to a first potential, a second electrode concentric with the first electrode and which can be brought to a second potential different from the first potential, and a plurality of intermediate electrodes concentric with respect to each other and concentrically between the first and second electrodes and which can be brought to a sequence of increasing potential levels between the first and second potentials, and (b) a switching device to which the electrodes of the capacitor stack are connected and which is configured such that, during operation of the switching device, the electrodes of the capacitor stack can be brought to the increasing potential levels, wherein the distance of the electrodes of the capacitor stack decreases toward the central electrode. An accelerator comprising such a DC high voltage source is also provided.

20 Claims, 7 Drawing Sheets

(56) References Cited

U.S. PATENT DOCUMENTS

| | | | | |
|---|---|---|---|---|
| 4,393,441 | A | 7/1983 | Enge | 363/61 |
| 4,972,420 | A | 11/1990 | Villa | 372/2 |
| 5,821,705 | A * | 10/1998 | Caporaso et al. | 315/507 |
| 6,459,766 | B1 | 10/2002 | Srinivasan-Rao | 378/119 |
| 6,653,642 | B2 * | 11/2003 | Pedersen et al. | 250/492.21 |
| 7,218,500 | B2 * | 5/2007 | Adachi | 361/226 |
| 7,924,121 | B2 * | 4/2011 | Caporaso et al. | 333/236 |
| 7,952,288 | B2 * | 5/2011 | Nakazato | 315/3.5 |
| 2012/0313554 | A1 * | 12/2012 | Heid | 315/503 |
| 2012/0313556 | A1 * | 12/2012 | Heid | 315/506 |

FOREIGN PATENT DOCUMENTS

| | | | | |
|---|---|---|---|---|
| DE | 69008835 | T2 | 8/1994 | H01S 3/09 |
| EP | 0412896 | A1 | 8/1990 | H05J 5/00 |
| EP | 0471601 | A2 | 2/2002 | H05H 5/00 |
| GB | 1330028 | | 9/1973 | H01J 33/00 |
| GB | 2003318 | A | 3/1979 | H05H 5/06 |

OTHER PUBLICATIONS

Greinacher, H.; "Erzeugung einer Gieichspannung vom vielfachen Betrage einer Wechselspannung ohne Transformator"; Schweiz. Elektrotechnischer Verein, Bulletin No. 3, Mar. 1920, 11. Jahrgang, p. 59-66.

Weiner, M.,: "Analysis of Cockcroft-Walton Voltage Multipliers with an Arbitraty Number of Stages"; The Review of Scientific Instruments, vol. 40, No. 2, Feb. 1969, p. 330-333, 1969.

Everhart at al,: "The Cockcroft-Walton Voltage Multiplying Circuit"; The Review of Scientific Instruments, vol. 24, No. 3, Mar. 1953, p. 221-226.

Greinacher, H.,: "Uber eine Methode, Wechselstrom mittels elektrischer Ventile und Kondensatoren in hochgespannten Gleichstrom umzuwandeln"; Zeitschrift für Physik, 4, Bd., Jan.-Mar. 1921, p. 195-205, Jan. 1921.

Schenkel, M.,: "Eine neue Sehaltung für die Erzeugung hoher Gleichspannungen", Elektrotechnische Zeitschrift, Berlin, Oct. 7, 1919, 40 Jahrgang, Heft 28, p. 333-334.

Descoeudres et al.: "DC Breakdown experiments for CLIC", Proceedings of EPAC08, EDMS Nr. 951279, CERN-TS-2008-006, Genoa, Italy p. 577, Jun. 23, 2008.

Spielrein: "Geometrisches zur elektrischen Festigkeitsrechnung", p. 78-85, Archiv für Elektrotechnik, 4(3), 1915.

Spielrein: "Geometrisches zur elektrischen Festigkeitsrechnung II", Archiv für Elektrotechnik, 1915, p. 244-254.

Rogowski et al.: "Ebene Funkenstrecke mit richtiger Randausbildung", Archiv für Elecktrotechnik, XV1, Band 1926, p. 73-75, 1926.

Reinhold, G., : "Ultra-high voltage DC power supplies for large currents", Technical Report E1-72, Emil Haefeli & Co. Ltd. Basel, Switzerland, 1987.

Shima et al.: "Optimum Thickness of Carbon Stripper in Tandem Accelerator in View of Transmission", TUP053, Proceedings of the Second Asian Particle Accelerator Conference, Beijing, China, 2001, p. 731-733.

Chao et al.: "Handbook of Accelerator Physics and Engineering", World Scientific, Singapore, New Jersey, London, HongKong, 2. edition, 1999, ISBN 9-810-23500-5, p. 440-441.

Cockcroft et al.: "Experiments with High Velocity Positive Ions", Proc. Roy. Soc., London, 136:619, 1932, p. 619-631, Jun. 1932.

Magnus et al.: "Formulas and Theorems for the Special Functions of Mathematical Physics", Springer-Verlag New York Inc. 1966, Band 52, 3. edition.

Abramowitz et al.: "Handbook of Mathematical Functions with Formulas, Graphs and Mathematical Tables", Dover Publications, New York, 10. edition, 1972, ISBN 486-61272-4,p. 375-499.

Bouwers, A.,: "Elektrische Höchstspannungen", Technische Physik in Einzeldarstellungen, Springer Verlag, 1939, p. 59.

Lesch, G.,: "Lehrbuch der Hochspannungstechnik", Springer Verlag, Berlin Göttingen, Heidelberg, 1959, p. 154-155.

Schwaiger et al.: "Elektrische Festigkeitslehre", Springer Verlag, 1925, p. 108-115, 172-173.

Biermanns: "Hochspannung und Hochleistung", Carl Hanser Verlag, München 1949, p. 50-56.

Betz: "Konforme Abbildung", Springer-Verlag 1948, Berlin,Göttingen, Heidelberg, p. 327-344.

Ramo et al: "Fields and Waves in Communication Electronics", Wiley 3. edition, 1993, ISBN 978-0-471-58551-0, p. 264-267.

Arnold et al.: "Die Transformatoren", vol. 2 of Die Wechselstromtechnik, Springer Verlag, Berlin, 2. edition, 1921, p. 22-30.

Belchenko et al., "Initial High Voltage Tests and Beam Injection Experiments on BINP Proton Tandem-Accelerator", Proc. RUPAC, 135, 2006.

Adler et al., "Advances in the Development of the Nested High Voltage Generator", Proc. SPIE, vol. 2374, 194, 1995.

Brautti et al.; "Tubeless vacuum insulated Cockroft-Walton accelerator"; Section—A: Accelerators, Spectrometers, Detectors and Associated Equipement, Elsevier, Amsterdam, NL, Bd, A328, Nr. 1/02, Apr. 15, 1993, pp. 59-63, XP000384484; Book.

Boggía et al.; "Prototype of a tubeless vacuum insulated accelerator"; Section—A: Accelerators, Sepctrometers, Detectors and Associated Equipment, Elsevier, Amsterdam, NL, Bd. 382, Nr. 1, Nov. 11, 1996, pp. 73-77; Book.

Boscolo I.; "The electronic test of the onion Cockcroft-Walton", Bd. 342, Mar. 22, 1994, pp. 309-313; Book.

Boscolo I. et al.; "A Cockcroft-Walton for Feltron: The New μ-Wave Source for TeV Colliders"; IEEE Service Center, New York, US, Bd. 39, Nr. 2 PT.02, Apr. 1, 1992, Seiten 308-314.

Peck, R.A., "Characteristics of a High-Frequency Cockcroft-Walton Voltage Source", The Review of Scientific Instruments, vol. 26, No. 5, pp. 441-448, May 1955.

Auble et al.: "A Procedure for Rapid Evaluation of Carbon Stripper Foils", Nuclear Instruments and Methods Phys. Res.200 (1982), p. 13-14, North-Holland Publishing Company, 1982.

Boscolo. I., "FELTRON, A Microwave Source for High Gradient TeV Collider", INFN and University of Milan, Italy, Bourgogne Technologies, Dijon, France; pp. 1188-1191, 1991.

Boscolo, I., "A Tunable Bragg Cavity for an Efficient Millimeter FEL Driven by Electrostatic Accelerators", Applied Physics, B57, pp. 217-225, 1993.

Boscolo, I., "A 1-MW, 1-mm Continuous-Wave FELtron for Toroidal Plasma Heating", IEEE Transactions on Plasma Science, vol. 20, No. 3; pp. 256-262, Jun. 1992.

Alston, L.L., "High Voltage Technology", Oxford University Press, London, ISBN 0-198-51702-5, pp. 59-94, 1968.

Cranberg, L., "The Initiation of Electrical Breakdown in Vacuum", Appl. Phys., 23(5), pp. 518-522, 1952.

Mulcahy, et al., "High Voltage Breakdown Study, Technical Report ECOM-0394-20", Ion Physics Corp., Burlington, MA; 84 pages, 1971.

Giere, et al., "HV Dielectric Strength of Shielding Electrodes in Vacuum Circuit-Breakers", XXth Int. Symposium on Discharges and Electrical Insulation in Vacuum, Tours, IEEE, p. 119-122, 2002.

International PCT Search Report and Written Opinion, PCT/EP2011/051462, 14 pages, Feb. 2, 2011.

International PCT Search Report and Written Opinion, PCT/EP2011/051463, 12 pages, Feb. 2, 2011.

* cited by examiner

DC HIGH VOLTAGE SOURCE AND PARTICLE ACCELERATOR

CROSS-REFERENCE TO RELATED APPLICATIONS

This application is a U.S. National Stage Application of International Application No. PCT/EP2011/051463 filed Feb. 2, 2011, which designates the United States of America, and claims priority to DE Patent Application No. 10 2010 008 992.3 filed Feb. 24, 2010. The contents of which are hereby incorporated by reference in their entirety.

TECHNICAL FIELD

This disclosure relates to a DC high-voltage source and a particle accelerator with a capacitor stack of electrodes concentrically arranged with respect to one another.

BACKGROUND

There are many applications which require a high DC voltage. By way of example, particle accelerators are one application; here charged particles are accelerated to high energies. In addition to their importance in fundamental research, particle accelerators are becoming ever more important in medicine and for many industrial purposes.

Until now, linear accelerators and cyclotrons have been used to produce a particle beam in the MV range, these usually being very complicated and complex instruments.

One type of known particle accelerators are the so-called electrostatic particle accelerators with a DC high-voltage source. Here, the particles to be accelerated are exposed to a static electric field.

By way of example, cascade accelerators (also Cockcroft-Walton accelerators) are known, in which a high DC voltage is generated by multiplying and rectifying an AC voltage by means of a Greinacher circuit, which is connected a number of times in series (cascaded), and hence a strong electric field is provided.

SUMMARY

In one embodiment, a DC high-voltage source for providing DC voltage includes (a) a capacitor stack with a first electrode, which can be brought to a first potential, a second electrode, which is concentrically arranged with respect to the first electrode and can be brought to a second potential that differs from the first potential, and a plurality of intermediate electrodes concentrically arranged with respect to one another, which are concentrically arranged between the first electrode and the second electrode and which can be brought to a sequence of increasing potential levels situated between the first potential and the second potential, and (b) a switching device, to which the electrodes of the capacitor stack are connected and which are embodied such that, during operation of the switching device, the electrodes of the capacitor stack concentrically arranged with respect to one another can be brought to increasing potential levels, wherein the spacing of the electrodes of the capacitor stack reduces toward the central electrode.

In a further embodiment, the switching device is embodied such that the electrodes of the capacitor stack can be charged from the outside, more particularly via the outermost electrode, with the aid of a pump AC voltage and thereby be brought to the increasing potential levels. In a further embodiment, the spacing of the electrodes, which decreases toward the central electrode of the capacitor stack is selected such that a substantially unchanging field strength forms between adjacent electrodes. In a further embodiment, the switching device comprises a high-voltage cascade, more particularly a Greinacher cascade or a Cockcroft-Walton cascade. In a further embodiment, the capacitor stack is subdivided into two mutually separate capacitor chains by a gap which runs through the electrodes. In a further embodiment, the switching device comprises a high-voltage cascade, which interconnects the two mutually separated capacitor chains and which, in particular, is arranged in the gap. In a further embodiment, the high-voltage cascade is a Greinacher cascade or a Cockcroft-Walton cascade. In a further embodiment, the switching device comprises diodes. In a further embodiment, the electrodes of the capacitor stack are formed such that they are situated on the surface of an ellipsoid, more particularly on the surface of a sphere, or on the surface of a cylinder. In a further embodiment, the central electrode is embedded in solid or liquid insulation material. In a further embodiment, the central electrode is insulated by a high vacuum.

In another embodiment, an accelerator for accelerating charged particles includes a DC high-voltage source having any of the features disclosed above, and an acceleration channel formed by openings in the electrodes of the capacitor stack such that charged particles can be accelerated through the acceleration channel. In a further embodiment, the particle source is arranged within the central electrode.

DETAILED DESCRIPTION

Figure 1:
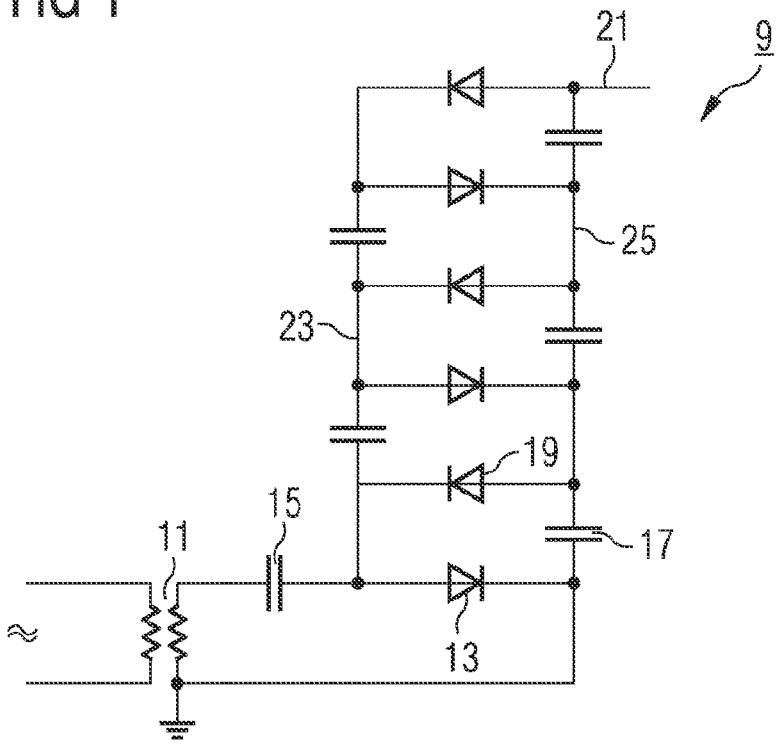
FIG. 1 shows a schematic illustration of a known Greinacher circuit.

Some embodiments provide a DC high-voltage source which, while having a compact design, enables a particularly high achievable DC voltage and at the same time enables an advantageous field-strength distribution around the high-voltage electrode. The invention is furthermore based on the object of specifying an accelerator for accelerating charged particles, which, while having a compact design, has a particularly high achievable particle energy.

For example, a DC high-voltage source for providing DC voltage may comprise:

a capacitor stack,

- with a first electrode, which can be brought to a first potential,
- with a second electrode, which is concentrically arranged with respect to the first electrode and can be brought to a second potential that differs from the first potential such that a potential difference can be formed between the first and second electrodes, and with a plurality of intermediate electrodes concentrically arranged with respect to one another, which are concentrically arranged between the first electrode and the second electrode and which can be brought to a sequence of increasing potential levels situated between the first potential and the second potential.

A switching device connects the electrodes of the capacitor stack—i.e. the first electrode, the second electrode and the intermediate electrodes—and is embodied such that, during operation of the switching device, the electrodes of the capacitor stack concentrically arranged with respect to one another can be brought to increasing potential levels. The electrodes of the capacitor stack are arranged such that the spacing of the electrodes of the capacitor stack reduces toward the central electrode.

Certain embodiments are based on the concept of enabling a configuration of the high-voltage source which is as efficient, i.e. as space-saving, as possible and, at the same time, providing an electrode arrangement here which makes it possible to enable simple charging capabilities in the case of an expedient field-strength distribution in the high-voltage source.

Overall, the concentric arrangement enables a compact design. Here, the high-voltage electrode can be the electrode situated in the center in the case of the concentric arrangement, while the outer electrode can be e.g. a ground electrode. For expedient use of the volume between the inner and the outer electrode, a plurality of concentric intermediate electrodes are brought to successively increasing potential levels. The potential levels can be selected such that this results in a largely uniform field strength in the interior of the entire volume.

The introduced intermediate electrodes moreover increase the dielectric field strength limit, and so higher DC voltages can be produced than without intermediate electrodes. This is due to the fact that the dielectric field strength in a vacuum is approximately inversely proportional to the square root of the electrode spacings. The introduced intermediate electrode(s), by means of which the electric field in the interior of the DC high-voltage source becomes more uniform, at the same time contribute to an advantageous increase in the possible, attainable field strength.

The decreasing spacing of the electrodes toward the center of the high-voltage source accommodates a field-strength distribution which is as uniform as possible between the first and the second electrode. This is because, as a result of the decreasing spacing, the electrodes in the vicinity of the center must have a smaller potential difference in order to achieve a substantially constant field-strength distribution around the high-voltage electrode. However, smaller potential differences are easier to implement using the switching device which interconnects the electrodes if by the electrodes are charged by the switching device. Losses that can occur during the charging by the switching device because the elements of the switching device themselves are lossy and that have a greater effect at higher potential levels can be compensated for by the decreasing electrode spacing.

Thus, the spacings from electrode to electrode of the capacitor stack reduce toward the central electrode and, in particular, can be selected such that a substantially unchanging field strength forms between adjacent electrodes. By way of example, this can mean that the field strength between an electrode pair differs from the field strength of adjacent electrode pairs by less than 30%, by less than 20%, in particular by less than 10% or most particularly by less than 5%, particularly in the unloaded case. What emerges from this is that the electric breakdown probability also remains substantially constant within the capacitor stack. If the unloaded case ensures stable operation with minimized breakdown probability, reliable operation is generally also ensured in the operating mode of the DC high-voltage cascade, e.g. during operation as voltage source for a particle accelerator.

The switching device is advantageously embodied such that the electrodes of the capacitor stack can be charged from the outside, more particularly via the outermost electrode, with the aid of a pump AC voltage and thereby be brought to the increasing potential levels toward the central electrode.

If such a DC high-voltage source is used e.g. for generating a beam of particles such as electrons, ions, elementary particles—or, in general, charged particles—it is possible to attain particle energy in the MV range in the case of a compact design.

In one embodiment, the switching device comprises a high-voltage cascade, more particularly a Greinacher cascade or a Cockcroft-Walton cascade. By means of such a device, it is possible to charge the electrodes of the capacitor stack, i.e. the first electrode, the second electrode and the intermediate electrodes, for generating the DC voltage by means of a comparatively low AC voltage. The AC voltage can be applied to the outermost electrode.

This embodiment is based on the concept of a high-voltage generation, as is made possible, for example, by a Greinacher rectifier cascade. Used in an accelerator, the electric potential energy serves to convert kinetic energy of the particles by virtue of the high potential being applied between the particle source and the end of the acceleration path.

In one embodiment variant, the capacitor stack is subdivided into two mutually separate capacitor chains by a gap which runs through the electrodes. As a result of separating the concentric electrodes of the capacitor stack into two mutually separate capacitor chains, the two capacitor chains can advantageously be used for forming a cascaded switching device such as a Greinacher cascade or Cockcroft-Walton cascade. Here, each capacitor chain constitutes an arrangement of (partial) electrodes which, in turn, are concentrically arranged with respect to one another.

In an embodiment of the electrode stack as spherical shell stack, the separation can be brought about by e.g. a cut along the equator, which then leads to two hemispherical stacks.

In the case of such a circuit, the individual capacitors of the chains can respectively be charged to the peak-peak voltage of the primary input AC voltage, which serves to charge the high-voltage source, such that, in the case of constant shell thicknesses, the aforementioned potential equilibration, a uniform electric field distribution and hence an optimal use of the insulation clearance is attained in a simple fashion.

The switching device, which comprises a high-voltage cascade, can interconnect the two mutually separated capacitor chains and, in particular, be arranged in the gap. The input AC voltage for the high-voltage cascade can be applied between the two outermost electrodes of the capacitor chains because, for example, these can be accessible from the outside. The diode chains of a rectifier circuit can then be applied in the equatorial gap—and hence in a space-saving manner.

On the basis of the embodiment in which the electrode stack is separated into two mutually separated capacitor chains by the gap it is possible to once again explain the advantage which is achieved by the electrode spacing which decreases toward the center.

The two capacitor chains substantially represent the capacitive load impedances of a transmission line for the pump AC voltage. The capacitance between the two capacitor chain stacks acts like a quadrature-axis impedance; moreover, the transmission line is twice damped by the distributed tapping of alternating current—and the conversion of the latter into charge direct current and load direct current by means of the diodes. The AC voltage amplitude therefore decreases toward the high-voltage electrode—and hence the DC voltage obtained per radial unit of length. If use were made in this case of a constant shell spacing or electrode spacing, the voltages between the inner electrodes and hence the E-field there would reduce and the insulation clearances would be used less effectively. This can be prevented by the reducing electrode spacing. As a result of the electrode spacing reducing toward the high-voltage electrode, it is also possible to expose the inner electrodes to a constantly high electric field strength. In the process, the dielectric field strength of the diodes can simultaneously be reduced in the interior.

The electrodes of the capacitor stack can be formed such that they are situated on the surface of an ellipsoid, more particularly on the surface of a sphere, or on the surface of a cylinder. These shapes are physically expedient. Selecting the shape of the electrodes as in the case of a hollow sphere or the spherical capacitor is particularly expedient. Similar shapes such as e.g. in the case of a cylinder are also possible, wherein the latter however usually has a comparatively inhomogeneous electric field distribution.

The low inductance of the shell-like potential electrodes allows the application of high operating frequencies, and so the voltage reduction during the current drain remains restricted despite relatively low capacitance of the individual capacitors.

The central high-voltage electrode can be embedded in solid or liquid insulation material.

Another possibility is to insulate the central high-voltage electrode by a high vacuum. The intermediate electrodes can also be respectively insulated by a vacuum with respect to one another. Using insulating materials is disadvantageous in that the materials tend to agglomerate internal charges—which are more particularly caused by ionizing radiation during the operation of the accelerator—when exposed to an electric DC field. The agglomerated, traveling charges cause a very inhomogeneous electric field strength in all physical insulators, which then leads to the breakdown limit being exceeded locally and hence to the formation of spark channels. Insulation by a high vacuum avoids such disadvantages. The electric field strength that can be used during stable operation can be increased thereby. As a result of this, the arrangement is substantially free from insulator materials—except for a few components such as e.g. the electrode mount.

Some embodiments provide an accelerator for accelerating charged particles that comprises a DC high-voltage source as discussed herein, and an acceleration channel formed by openings in the electrodes of the capacitor stack such that charged particles can be accelerated through the acceleration channel. Here, the electric potential energy provided by the high-voltage source is used to accelerate the charged particles. The potential difference is applied between particle source and target. The central high-voltage electrode can for example contain the particle source.

In the case of an accelerator, the use of a vacuum for insulating the electrodes may be advantageous in that there is no need to provide a dedicated beam tube, which in turn at least in part has an insulator surface. This may also prevent critical problems of the wall discharge from occurring along the insulator surfaces because the acceleration channel now no longer needs to have insulator surfaces.

The principle of a high-voltage cascade 9, which is configured as per a Greinacher circuit, should be clarified using the circuit diagram in FIG. 1.

Figure 2:
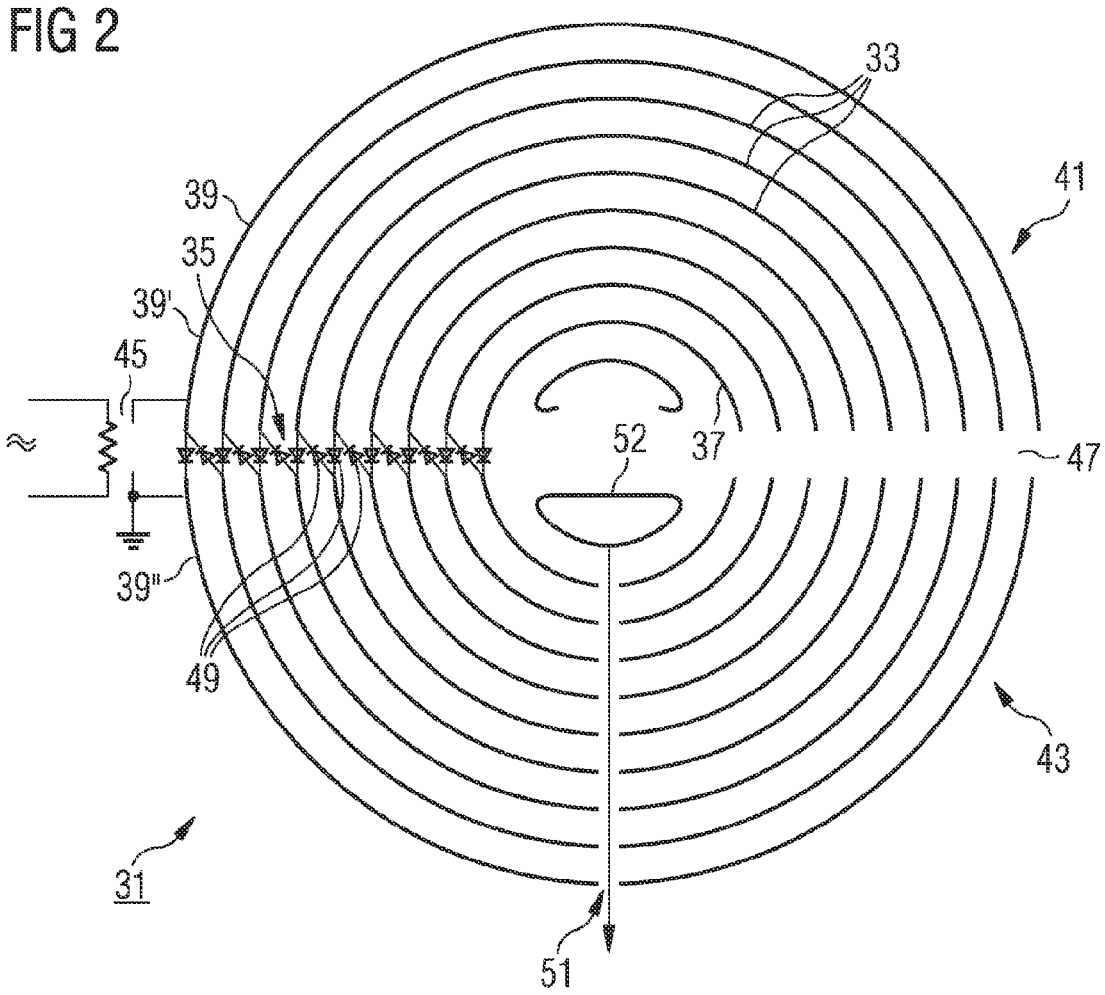
FIG. 2 shows a schematic illustration of a section through a DC high-voltage source with a particle source in the center.

An AC voltage U is applied to an input 11. The first half-wave charges the capacitor 15 to the voltage U via the diode 13. In the subsequent half-wave of the AC voltage, the voltage U from the capacitor 13 is added to the voltage U at the input 11, such that the capacitor 17 is now charged to the voltage 2U via the diode 19. This process is repeated in the subsequent diodes and capacitors, and so the voltage 6U is obtained in total at the output 21 in the case of the circuit shown in FIG. 1. FIG. 2 also clearly shows how, as a result of the illustrated circuit, the first set 23 of capacitors respectively forms a first capacitor chain and the second set 25 of capacitors respectively forms a second capacitor chain.

Figure 5:
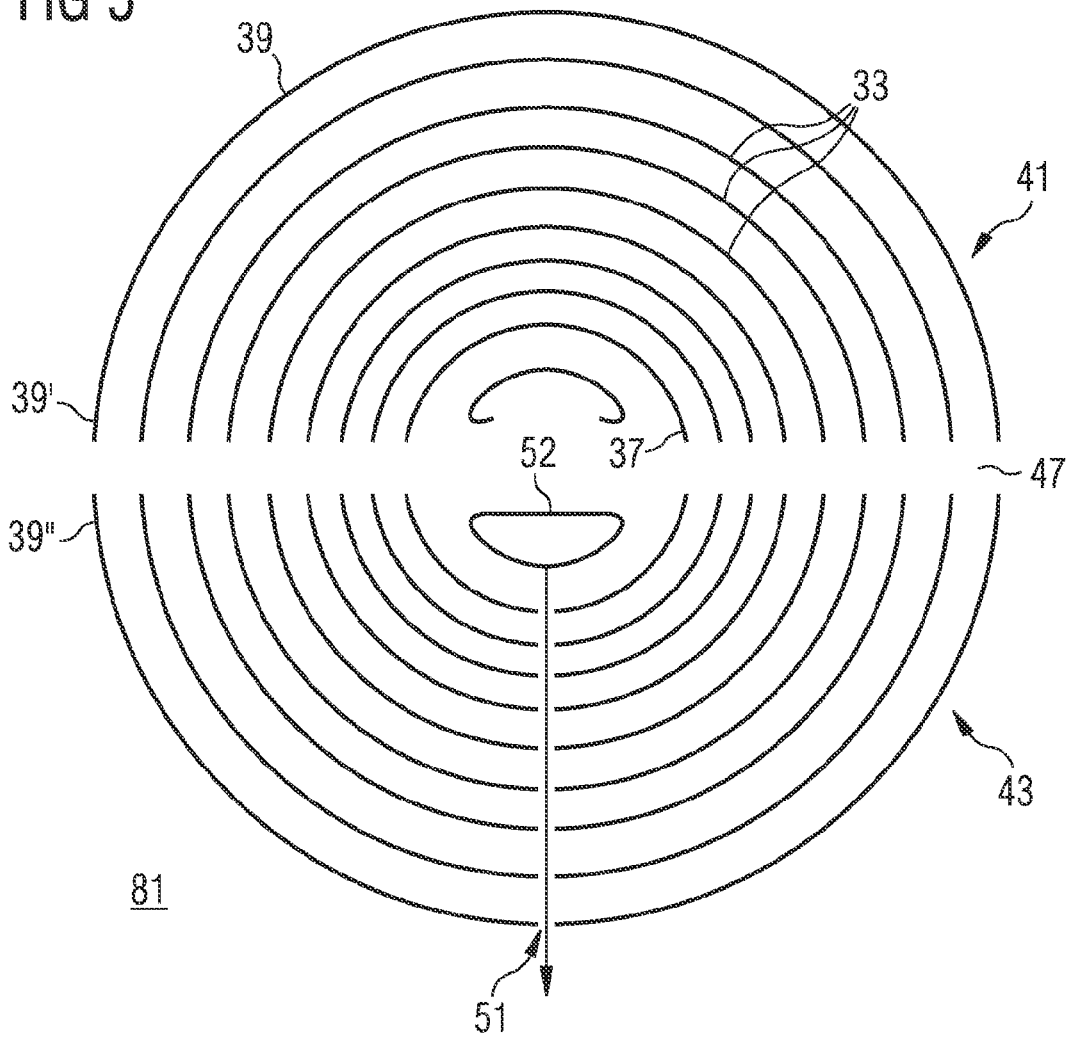
FIG. 5 shows a schematic illustration of a section through a DC high-voltage source according to FIG. 2, with an electrode spacing decreasing toward the center.

FIG. 2 is now used to explain the principle of a DC high-voltage source; the development according to the invention will then be explained on the basis of FIG. 5.

FIG. 2 shows a schematic section through a high-voltage source 31 with a central electrode 37, an outer electrode 39 and a row of intermediate electrodes 33, which are interconnected by a high-voltage cascade 35, the principle of which was explained in FIG. 1, and which can be charged by this high-voltage cascade 35.

The electrodes 39, 37, 33 are embodied in the form of a hollow sphere and arranged concentrically with respect to one another. The maximum electric field strength that can be applied is proportional to the curvature of the electrodes. Therefore a spherical shell geometry is particularly expedient.

Situated in the center there is the high-voltage electrode 37; the outermost electrode 39 can be a ground electrode. As a result of an equatorial cut 47, the electrodes 37, 39, 33 are subdivided into two mutually separate hemispherical stacks which are separated by a gap. The first hemispherical stack forms a first capacitor chain 41 and the second hemispherical stack forms a second capacitor chain 43.

In the process, the voltage U of an AC voltage source 45 is respectively applied to the outermost electrode shell halves 39', 39". The diodes 49 for forming the circuit are arranged in the region of the great circle of halves of the hollow spheres, i.e. in the equatorial cut 47 of the respective hollow spheres. The diodes 49 form the cross-connections between the two capacitor chains 41, 43, which correspond to the two sets 23, 25 of capacitors from FIG. 1.

In the case of the high-voltage source 31 illustrated here, an acceleration channel 51, which runs from e.g. a particle source 52 arranged in the interior and enables the particle beam to be extracted, is routed through the second capacitor chain 43.

The particle stream of charged particles experiences a high acceleration voltage from the hollow-sphere-shaped high-voltage electrode 37.

The high-voltage source 31 and the particle accelerator are advantageous in that the high-voltage generator and the particle accelerator are integrated into one another because in this case all electrodes and intermediate electrodes can be housed in the smallest possible volume.

In order to insulate the high-voltage electrode 37, the whole electrode arrangement is insulated by vacuum insulation. Inter alia, this affords the possibility of generating particularly high voltages of the high-voltage electrode 37, which results in a particularly high particle energy. However, in principle, insulating the high-voltage electrode by means of solid or liquid insulation is also possible.

The use of vacuum as an insulator and the use of an intermediate electrode spacing of the order of magnitude of 1 cm affords the possibility of achieving electric field strengths with values of more than 20 MV/m. Moreover, the use of a vacuum is advantageous in that the accelerator need not operate at low load during operation due to the radiation occurring during the acceleration possibly leading to problems in insulator materials. This allows the design of smaller and more compact machines.

FIG. 5 shows the development according to the invention of the principle of the high-voltage source, explained on the basis of FIG. 2, in which the spacing of the electrodes 39, 37, 33 decreases toward the center. As explained previously, as a result of such an embodiment, it is possible to compensate for the decrease of the pump AC voltage, applied to the outermost electrode 39, toward the center such that a substantially identical field strength nevertheless prevails between adjacent electrode pairs. As a result of this, it is possible to achieve a largely constant field strength along the acceleration channel 51.

Figure 3:
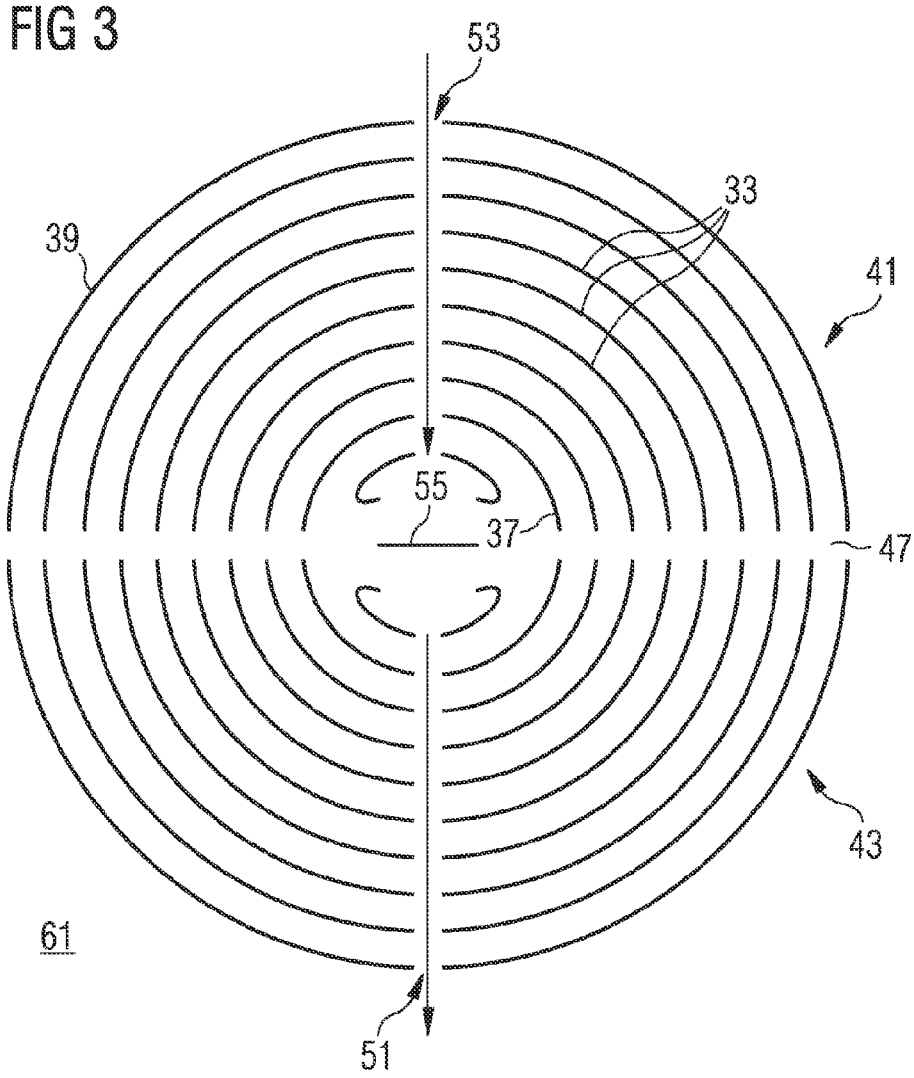
FIG. 3 shows a schematic illustration of a section through a DC high-voltage source which is embodied as tandem accelerator.

FIG. 3 shows a development of the high-voltage source shown in FIG. 2 as the tandem accelerator 61. The circuit device 35 from FIG. 2 is not illustrated for reasons of clarity, but is identical in the case of the high-voltage source shown in FIG. 3. FIG. 3 is used to explain the principle of the tandem accelerator. An embodiment as per FIG. 5 with an electrode spacing decreasing toward the center can likewise be applied. However, this is not illustrated in FIG. 3 because it is not required for explaining the basic principle of the tandem accelerator 61.

In the example illustrated here, the first capacitor chain 41 also has an acceleration channel 53 which is routed through the electrodes 33, 37, 39.

In the interior of the central high-voltage electrode 37, a carbon film 55 for charge stripping is arranged in place of the particle source. Negatively charged ions can then be generated outside of the high-voltage source 61, accelerated along the acceleration channel 53 through the first capacitor chain 41 to the central high-voltage electrode 37, be converted into positively charged ions when passing through the carbon film 55 and subsequently be accelerated further through the acceleration channel 51 of the second capacitor chain 43 and reemerge from the high-voltage source 31.

The outermost spherical shell 39 can remain largely closed and thus assume the function of a grounded housing. The hemispherical shell situated directly therebelow can then be the capacitor of an LC resonant circuit and part of the drive connector of the switching device.

Such a tandem accelerator uses negatively charged particles. The negatively charged particles are accelerated through the first acceleration path 53 from the outer electrode 39 to the central high-voltage electrode 37.

A charge conversion process occurs at the central high-voltage electrode 37.

By way of example, this can be brought about by a film 55, through which the negatively charged particles are routed and with the aid of which so-called charge stripping is carried out. The resulting positively charged particles are further accelerated through the second acceleration path 51 from the high-voltage electrode 37 back to the outer electrode 39. Here, the charge conversion can also be brought about such that multiply positively charged particles, such as e.g. $C^{4+}$, are created, which are accelerated particularly strongly by the second acceleration path 51.

One embodiment of the tandem accelerator provides for the generation of a proton beam of 1 mA strength using an energy of 20 MeV. To this end, a continuous flow of particles is introduced into the first acceleration path 53 from an $H^-$-particle source and accelerated toward the central +10 MV electrode. The particles impinge on a carbon charge stripper, as a result of which both electrons are removed from the protons. The load current of the Greinacher cascade is therefore twice as large as the current of the particle beam.

The protons obtain a further 10 MeV of energy while they emerge from the accelerator through the second acceleration path 53.

For such a type of acceleration, the accelerator can provide a 10 MV high-voltage source with N=50 levels, i.e. a total of 100 diodes and capacitors. In the case of an inner radius of r=0.05 m and a vacuum insulation with a dielectric field strength of 20 MV/m, the outer radius is 0.55 m. In each hemisphere there are 50 intermediate spaces with a spacing of 1 cm between adjacent spherical shells.

A smaller number of levels reduces the number of charge cycles and the effective internal source impedance, but increases the demands made on the pump charge voltage.

The diodes arranged in the equatorial gap, which interconnect the two hemisphere stacks can, for example, be arranged in a spiral-like pattern. According to equation (3.4), the total capacitance can be 74 pF and the stored energy can be 3.7 kJ. A charge current of 2 mA requires an operating frequency of approximately 100 kHz.

If carbon films are used for charge stripping, it is possible to use films with a film thickness of $t \approx 15 \ldots 30\ \mu g/cm^2$. This thickness represents a good compromise between particle transparency and effectiveness of the charge stripping.

The lifetime of a carbon stripper film can be estimated using $T_{foil}=k_{foil}*(UA)/(Z^2I)$, where I is the beam current, A is the spot area of the beam, U is the particle energy and Z is the particle mass. Vapor-deposited films have a value of $kfoil \approx 1.1\ C/Vm^2$.

Carbon films, which are produced by the disintegration of ethylene by means of glow discharge have a thickness-dependent lifetime constant of $kfoil \approx (0.44\ t-0.60)\ C/Vm^2$, wherein the thickness is specified in $\mu g/cm^2$.

In the case of a beam diameter of 1 cm and a beam current strength of 1 mA, a lifetime of 10 . . . 50 days can be expected in this case. Longer lifetimes can be achieved by increasing the effective irradiated surface, for example by scanning a rotating disk or a film with a linear tape structure.

Figure 4:
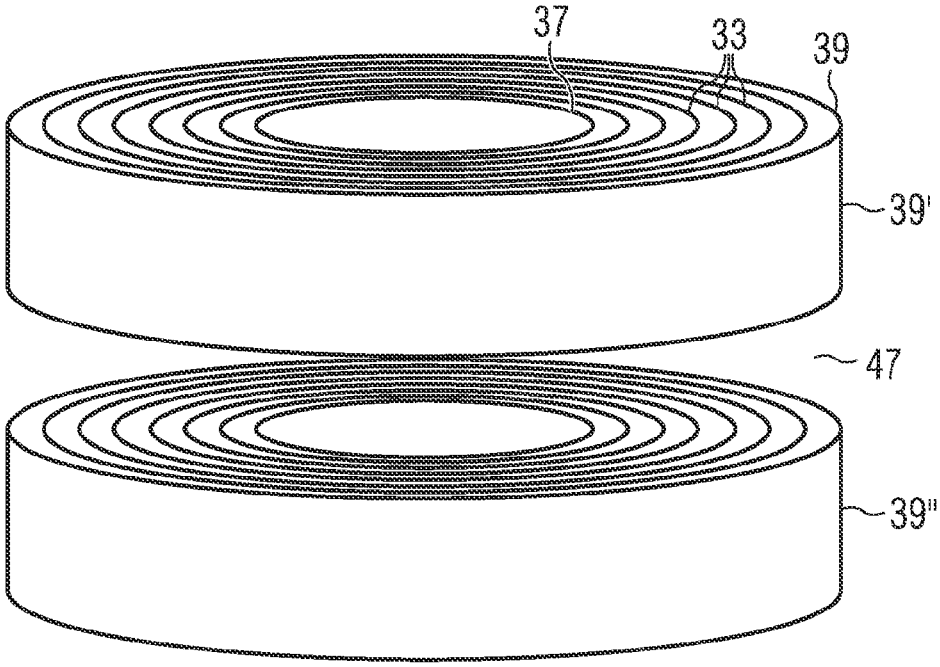
FIG. 4 shows a schematic illustration of the electrode design with a stack of cylindrically arranged electrodes.

FIG. 4 illustrates an electrode form in which hollow-cylinder-shaped electrodes 33, 37, 39 are arranged concentrically with respect to one another. A gap divides the electrode stack into two mutually separate capacitor chains, which can be connected by a switching device with a configuration analogous to the one in FIG. 2.

Here (not illustrated) it is also possible for the electrode spacings to reduce toward the central axis, as explained for the spherical shape on the basis of FIG. 5.

Figure 6:
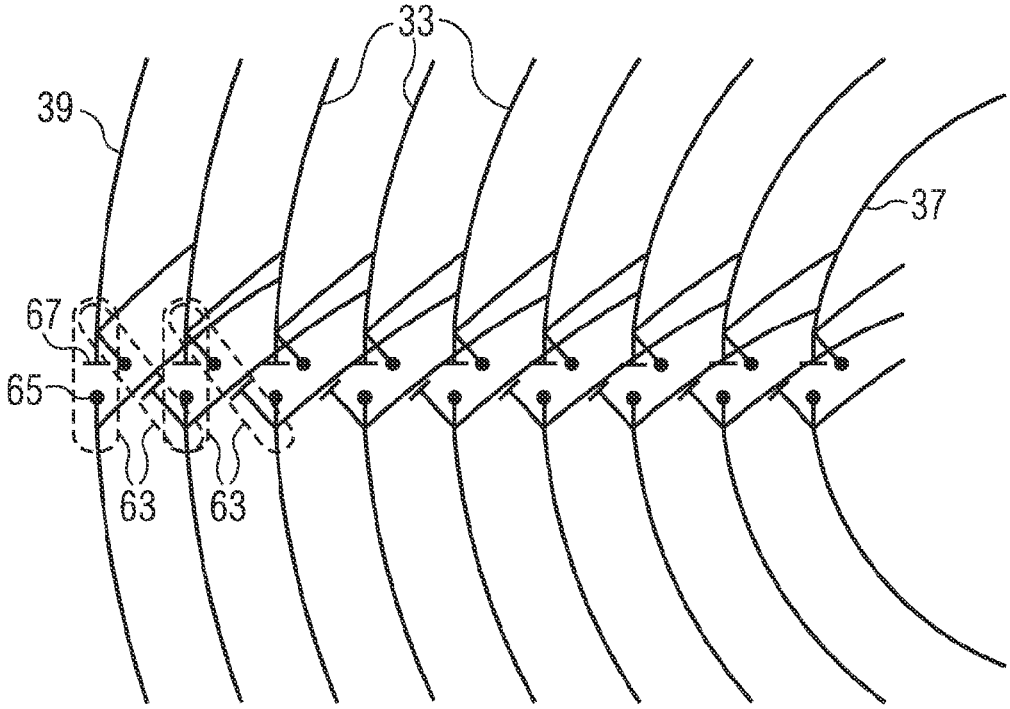
FIG. 6 shows an illustration of the diodes of the switching device, which diodes are embodied as vacuum-flask-free electron tubes.

FIG. 6 shows a shown embodiment of the diodes of the switching device. The concentrically arranged, hemisphere-shell-like electrodes 39, 37, 33 are only indicated in the illustration for reasons of clarity.

In this case, the diodes are shown as electron tubes 63, with a cathode 65 and an anode 67 opposite thereto. Since the switching device is arranged within the vacuum insulation, the vacuum flask of the electron tubes, which would otherwise be required for operating the electrons, can be dispensed with.

In the following text, more detailed explanations will be offered in respect of components of the high-voltage source or in respect of the particle accelerator.

Spherical Capacitor

The arrangement follows the principle shown in FIG. 1 of arranging the high-voltage electrode in the interior of the accelerator and the concentric ground electrode on the outside of the accelerator.

A spherical capacitor with an inner radius r and an outer radius R has the capacitance given by $$C = 4\pi\epsilon_0 \frac{rR}{R-r}. \tag{3.1}$$

The field strength at a radius ρ is then given by $$E = \frac{rR}{(R-r)\rho^2} U \tag{3.2}$$

This field strength has a quadratic dependence on the radius and therefore increases strongly toward the inner electrode. At the inner electrode surface ρ=r, the maximum $$\hat{E} = \frac{R}{r(R-r)} U \tag{3.3}$$

has been attained. This is disadvantageous from the point of view of the dielectric field strength.

A hypothetical spherical capacitor with a homogeneous electric field would have the following capacitance:

$$\hat{C} = 4\pi\epsilon_0 \frac{R^2 + rR + r^2}{R-r}. \tag{3.4}$$

As a result of the fact that the electrodes of the capacitors of the Greinacher cascade have been inserted as intermediate electrodes at a clearly defined potential in the cascade accelerator, the field strength distribution is linearly fitted over the radius because, for thin-walled hollow spheres, the electric field strength approximately equals the flat case $$E \to \frac{U}{(R-r)}. \tag{3.5}$$

with minimal maximum field strength.

The capacitance between two adjacent intermediate electrodes is given by $$C_k = 4\pi\epsilon_0 \frac{r_k r_{k+1}}{r_{k+1} - r_k}. \tag{3.6}$$

Hemispherical electrodes and equal electrode spacing d=(R−r)/N leads to $r_k$=r+kd and to the following electrode capacitances:

$$C_{2k} = C_{2k+1} = 2\pi\epsilon_0 \frac{r^2 + rd + (2rd + d^2)k + d^2k^2}{d}. \tag{3.7}$$

Rectifier

Modern soft avalanche semiconductor diodes have very low parasitic capacitances and have short recovery times. A connection in series requires no resistors for equilibrating the potential. The operating frequency can be selected to be comparatively high in order to use the relatively small inter-electrode capacitances of the two Greinacher capacitor stacks.

In the case of a pump voltage for charging the Greinacher cascade, it is possible to use a voltage of $U_{in}$≈100 kV, i.e. 70 $kV_{eff}$. The diodes must withstand voltages of 200 kV. This can be achieved by virtue of the fact that use is made of chains of diodes with a lower tolerance. By way of example, use can be made of ten 20 kV diodes. By way of example, diodes can be BY724 diodes by Philips, BR757-200A diodes by EDAL or ESJA5320A diodes by Fuji.

Fast reverse recovery times, e.g. $t_{rr}$≈100 ns for BY724, minimize losses. The dimensions of the BY724 diode of 2.5 mm×12.5 mm make it possible to house all 1000 diodes for the switching device in a single equatorial plane for the spherical tandem accelerator specified in more detail below.

In place of solid-state diodes, it is also possible to use electron tubes in which the electron emission is used for rectification. The chain of diodes can be formed by a multiplicity of electrodes, arranged in a mesh-like fashion with respect to one another, of the electron tubes, which are connected to the hemispherical shells. Each electrode acts as a cathode on one hand and as an anode on the other hand.

Discrete Capacitor Stack

The central concept consists of cutting through the electrodes, which are concentrically arranged in succession, on an equatorial plane. The two resultant electrode stacks constitute the cascade capacitors. All that is required is to connect the chain of diodes to opposing electrodes over the plane of the cut. It should be noted that the rectifier automatically stabilizes the potential differences of the successively arranged electrodes to approximately 2 $U_{in}$, which suggests constant electrode spacings. The drive voltage is applied between the two outer hemispheres.

Ideal Capacitance Distribution

If the circuit only contains the capacitors from FIG. 3, the stationary operation supplies an operating frequency f, a charge $$Q = \frac{I_{out}}{f} \tag{3.8}$$

per full wave in the load through the capacitor $C_0$. Each of the capacitor pairs $C_{2k}$ and $C_{2k+1}$ therefore transmits a charge (k+1)Q.

The charge pump represents a generator-source impedance $$R_G = \frac{1}{2f} \sum_{k=0}^{N-1} \left( \frac{2k^2 + 3k + 1}{C_{2k}} + \frac{2k^2 + 4k + 2}{C_{2k+1}} \right). \tag{3.9}$$

As a result, a load current $I_{out}$ reduces the DC output voltage as per $$U_{out} = 2NU_{in} - R_G I_{out}. \tag{3.10}$$

The load current causes a residual AC ripple at the DC output with the peak-to-peak value of $$\delta U = \frac{I_{out}}{f}\sum_{k=0}^{N-1}\frac{k+1}{C_{2k}}. \tag{3.11}$$

If all capacitors are equal to $C_k$=C, the effective source impedance is $$R_G = \frac{8N^3 + 9N^2 + N}{12fC} \tag{3.12}$$

and the peak-to-peak value of the AC ripple becomes $$\delta U = \frac{I_{out}}{fC}\frac{N^2 + N}{2}. \tag{3.13}$$

For a given total-energy store within the rectifier, a capacitive inequality slightly reduces the values $R_G$ and $R_R$ compared to the conventional selection of identical capacitors in favor of the low-voltage part.

Figure 7:
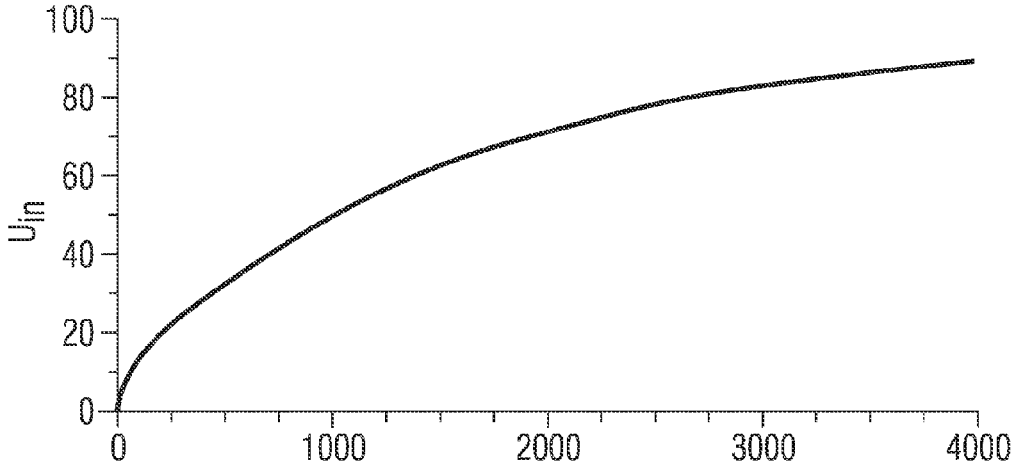
FIG. 7 shows a diagram showing the charging process as a function of pump cycles.

FIG. 7 shows the charging of an uncharged cascade of N=50 concentric hemispheres, plotted over the number of pump cycles.

Leakage Capacitances

Any charge exchange between the two columns reduces the efficiency of the multiplier circuit, see FIG. 1, e.g. as a result of the leakage capacitances $c_j$ and the reverse recovery charge loss $q_j$ by the diodes $D_j$.

The basic equations for the capacitor voltages $U_k^{\pm}$ at the positive and negative extrema of the peak drive voltage U, with the diode forward voltage drop being ignored, are:

$$U_{2k}^{+}=u_{2k+1} \tag{3.14}$$

$$U_{2k}^{-}=u_{2k} \tag{3.15}$$

$$U_{2k+1}^{+}=u_{2k+1} \tag{3.16}$$

$$U_{2k+1}^{-}u_{2k+2} \tag{3.17}$$

up to the index 2N−2 and $$U_{2N-1}u_{2N-1}-U \tag{3.18}$$

$$U_{2N-1}^{-}=U. \tag{3.19}$$

Using this nomenclature, the mean amplitude of the DC output voltage is $$U_{out} = \frac{1}{2}\sum_{k=0}^{2N-1} u_k. \tag{3.20}$$

The peak-to-peak value of the ripple in the DC voltage is $$\delta U = \sum_{k=0}^{2N-1}(-1)^{k+1}u_k. \tag{3.21}$$

With leakage capacitances $c_i$ parallel to the diodes $D_i$, the basic equations for the variables are $u_{-1}$=0, $U_{2N}$=2 U, and the tridiagonal system of equations is $$C_{k-1}u_{k-1} - (C_{k-1} + C_k)u_k + (C_k - c_k)u_{k+1} = \begin{cases} Q & \forall k \text{ even} \\ 0 & \forall k \text{ odd.} \end{cases} \tag{3.22}$$

Reverse Recovery Charges

Finite reverse recovery times $t_{rr}$ of the delimited diodes cause a charge loss of $$\eta_0=\eta Q_D \tag{3.23}$$

with $\eta$=f $t_{rr}$ and $Q_D$ for the charge per full wave in the forward direction. Equation (3.22) then becomes:

$$C_{k-1}u_{k-1} - (C_{k-1} + (1-\eta)C_k)u_k + ((1-\eta)C_k - c_k)u_{k+1} = \begin{cases} Q & \forall k \text{ even} \\ 0 & \forall k \text{ odd.} \end{cases} \tag{3.24}$$

Continuous Capacitor Stack

Capacitive Transmission Line

In Greinacher cascades, the rectifier diodes substantially take up the AC voltage, convert it into DC voltage and accumulate the latter to a high DC output voltage. The AC voltage is routed to the high-voltage electrode by the two capacitor columns and damped by the rectifier currents and leakage capacitances between the two columns.

For a large number N of levels, this discrete structure can be approximated by a continuous transmission-line structure.

For the AC voltage, the capacitor design constitutes a longitudinal impedance with a length-specific impedance 3.

Leakage capacitances between the two columns introduce a length-specific shunt admittance $\mathfrak{Y}$ . The voltage stacking of the rectifier diodes brings about an additional specific current load J, which is proportional to the DC load current $I_{out}$ and to the density of the taps along the transmission line.

The basic equations for the AC voltage U(x) between the columns and the AC direct-axis current I(x) are $$I'=\mathfrak{Y}\,U+J \tag{3.25}$$

$$U'=3I \tag{3.26}$$

The general equation is an extended telegraph equation:

$$U'' - \frac{3'}{3}U' - 3\mathfrak{Y}U = 3\mathfrak{J}. \tag{3.27}$$

In general, the peak-to-peak ripple at the DC output equals the difference of the AC voltage amplitude at both ends of the transmission line.

$$\delta U=U(\chi_0)-U(\chi_1) \tag{3.28}$$

Two boundary conditions are required for a unique solution of this second order differential equation.

One of the boundary conditions can be U $(x_0)=U_{in}$, given by the AC drive voltage between the DC low-voltage ends of the two columns. The other natural boundary condition determines the AC current at the DC high-voltage end $x=x_1$. The boundary condition for a concentrated terminal AC impedance $Z_1$ between the columns is:

$$U'(x_1) = \frac{3(x_1)}{Z_1}U(x_1). \tag{3.29}$$

In the unloaded case $Z_1=\infty$, the boundary condition is U' $(x_1)$=0.

Constant Electrode Spacing

For a constant electrode spacing t, the specific load current is $$\mathfrak{J} = \frac{t\pi I_{out}}{t}; \tag{3.30}$$

and so the distribution of the AC voltage is regulated by $$U'' - \frac{3'}{3}U' - 3\mathfrak{Y}U = 3\mathfrak{J}. \tag{3.31}$$

The average DC output voltage then is $$U_{out} = \frac{2U_{in}}{t}\int_0^{Nt} U(x)dx \tag{3.32}$$

and the DC peak-to-peak ripple of the DC-voltage is $$\delta U = U(Nt) - U(0) \tag{3.33}$$

Optimal Electrode Spacing

The optimal electrode spacing ensures a constant electric DC field strength 2 E in the case of the planned DC load current. The specific AC load current along the transmission line, depending on the position, is $$\mathfrak{J} = \frac{t\pi E I_{out}}{U}. \tag{3.34}$$

The AC voltage follows from $$UU'' - \frac{3'}{3}UU' - 3\mathfrak{Y}U^2 = 3t\pi E I_{out}. \tag{3.35}$$

The electrode spacings emerge from the local AC voltage amplitudes t(x)=U(x)/E.

The DC output voltage in the case of the planned DC load current is $U_{out}$=2Ed. A reduction in the load always increases the voltages between the electrodes; hence operation with little or no load can exceed the admissible E and the maximum load capacity of the rectifier columns. It can therefore be recommendable to optimize the design for unloaded operation.

For any given electrode distribution that differs from the one in the configuration for a planned DC load current, the AC voltage along the transmission line and hence the DC output voltage is regulated by equation (3.27).

Linear Cascade

In the case of a linear cascade with flat electrodes with the width w, height h and a spacing s between the columns, the transmission line impedances are $$3 = \frac{2}{t\epsilon_0\omega wh}, \quad \mathfrak{Y} = \frac{t\epsilon_0\omega w}{s}. \tag{3.36}$$

Linear Cascade—Constant Electrode Spacing

The inhomogeneous telegraph equation is $$U'' - \frac{2}{hs}U = \frac{I_{out}}{f\epsilon_0 wht}. \tag{3.37}$$

Under the assumption of a line which extends from x=0 to x=d=Nt and is operated by $U_{in}$=U (0), and of a propagation constant of $\gamma^2$=2/(h*s), the solution is $$U(x) = \frac{\cosh\gamma x}{\cosh\gamma d}U_{in} + \left(\frac{\cosh\gamma x}{\cosh\gamma d} - 1\right)\frac{Ns}{2f\epsilon_0 dw}I_{out}. \tag{3.38}$$

The diodes substantially tap the AC voltage, rectify it and accumulate it along the transmission line. Hence, the average DC output voltage is $$U_{out} = \frac{2}{t}\int_0^d U(x)dx. \tag{3.39}$$

or—explicitly—

$$U_{out} = 2N\frac{\tanh\gamma d}{\gamma d}U_{in} + \left(\frac{\tanh\gamma d}{\gamma d} - 1\right)\frac{N^2 s}{f\epsilon_0 dw}I_{out}. \tag{3.40}$$

A series expansion up to the third order in γd results in $$U_{out} \approx 2NU_{in}\left(1 - \frac{2d^2}{3hs}\right) - \frac{2N^2}{3f}\frac{d}{\epsilon_0 hw}I_{out} \tag{3.41}$$

and $$\delta U \approx \frac{d^2}{hs}U_{in} + \frac{N}{f}\frac{d}{2\epsilon_0 hw}I_{out}. \tag{3.42}$$

The load-current-related effects correspond to equation (3.12) and (3.13).

Linear Cascade—Optimal Electrode Spacing

In this case, the basic equation is $$UU'' - \frac{2}{hs}U^2 = \frac{EI_{out}}{f\epsilon_0 wh}. \tag{3.43}$$

It appears as if this differential equation has no closed analytical solution. The implicit solution which satisfies U'(0)=0 is $$x = \int_{U(0)}^{U(x)} \frac{du}{\sqrt{\frac{2}{hs}(u^2 - U^2(0)) + \frac{EI_{out}}{f\epsilon_0 wh}\log\frac{u}{U(0)}}}. \tag{3.44}$$

Radial Cascade

Under the assumption of a stack of concentric cylinder electrodes with a radius-independent height h and an axial gap between the columns as shown in FIG. 4, the radial-specific impedances are $$3 = \frac{1}{t\pi\epsilon_0\omega rh}, \quad \mathfrak{Y} = \frac{2t\pi\epsilon_0 wr}{s}. \tag{3.45}$$

Radial Cascade—Constant Electrode Spacing

With an equidistant radial electrode spacing t=(R-r)/N, the basic equation $$U'' + \frac{1}{\rho}U' - \frac{2}{hs}U = \frac{I_{out}}{\epsilon_0 \omega h t \rho} \tag{3.46}$$

has the general solution $$U(\rho) = AK_0(\gamma\rho) + BI_0(\gamma\rho) + \frac{I_{out}}{4\gamma f \epsilon_0 h t} L_0(\gamma\rho). \tag{3.47}$$

with $\gamma^2=2/(h*s)$. $K_0$ and $I_0$ are the modified Bessel functions and $L_0$ is the modified STRUVE function $L_0$ of the zeroth order.

The boundary conditions U' (r)=0 at the inner radius r and U (R)=$U_{in}$ at the outer radius R determine the two constants $$A = \frac{U_{in} I_1(\gamma r) - \frac{I_{out}}{4\gamma f \epsilon_0 h t}\left[I_1(\gamma r)L_0(\gamma R) - I_0(\gamma R)\left(L_1(\gamma r) + \frac{2}{\pi}\right)\right]}{I_0(\gamma R)K_1(\gamma r) + I_1(\gamma r)K_0(\gamma R)} \tag{3.48}$$

$$B = \frac{U_{in} K_1(\gamma r) - \frac{I_{out}}{4\gamma f \epsilon_0 h t}\left[K_1(\gamma r)L_0(\gamma R) + K_0(\gamma R)\left(L_1(\gamma r) + \frac{2}{\pi}\right)\right]}{I_0(\gamma R)K_1(\gamma r) + I_1(\gamma r)K_0(\gamma R)} \tag{3.49}$$

such that $$U(\rho) = U_{in}\frac{I_0(\gamma\rho)K_1(\gamma r) + I_1(\gamma r)K_0(\gamma\rho)}{I_0(\gamma R)K_1(\gamma r) + I_1(\gamma r)K_0(\gamma R)} + \frac{I_{out}}{4\gamma f \epsilon_0 h t}\left[L_0(\gamma\rho) - L_0(\gamma R)\frac{I_0(\gamma\rho)K_1(\gamma r) + I_1(\gamma r)K_0(\gamma\rho)}{I_0(\gamma R)K_1(\gamma r) + I_1(\gamma r)K_0(\gamma R)} - \left(L_1(\gamma r) + \frac{2}{\pi}\right)\frac{I_0(\gamma\rho)K_0(\gamma R) - I_0(\gamma R)K_0(\gamma\rho)}{I_0(\gamma R)K_1(\gamma r) + I_1(\gamma r)K_0(\gamma R)}\right]. \tag{3.50}$$

$K_1$ and $I_1$ are the modified Bessel functions and $L_1$ is the modified Struve function $L_1=L'_o-2/n$, all of first order.

The DC output voltage is $$U_{out} = \frac{2}{t}\int_r^R U(\rho)d\rho. \tag{3.51}$$

Radial Cascade—Optimal Electrode Spacing

The optimal local electrode spacing is t(ρ)=U(ρ)/E and the basic equation becomes $$UU'' + \frac{1}{\rho}UU' - \frac{2}{hs}U^2 = \frac{EI_{out}}{\epsilon_0 \omega h \rho} \tag{3.52}$$

It appears as if this differential equation has no closed analytical solution, but it can be solved numerically.

Electrode Shapes

Equipotential Surfaces

A compact machine requires the dielectric field strength to be maximized. Generally smooth surfaces with small curvature should be selected for the capacitor electrodes. As a rough approximation, the electric breakdown field strength E scales with the inverse square root of the electrode spacing, and so a large number of closely spaced apart equipotential surfaces with smaller voltage differences should be preferred over a few large distances with large voltage differences.

Minimal E-Field Electrode Edges

Figure 8:
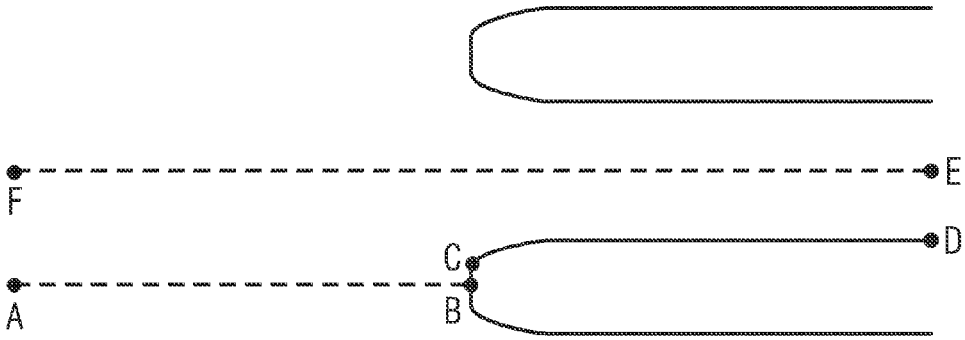
FIG. 8 shows a Kirchhoff-form of the electrode ends.

For a substantially planar electrode design with equidistant spacing and a linear voltage distribution, the optimal edge-shape is known as KIRCHHOFF form (see below), $$x = \frac{A}{2\pi}\ln\frac{1+\cos\vartheta}{1-\cos\vartheta} - \frac{1+A^2}{4\pi}\ln\frac{1+2A\cos\vartheta + A^2}{1-2A\cos\vartheta + A^2} \tag{3.53}$$

$$y = \frac{b}{2} + \frac{1-A^2}{2\pi}\left(\arctan\frac{2A}{1-A^2} - \arctan\frac{2A\sin\vartheta}{1-A^2}\right). \tag{3.54}$$

dependent on the parameters [0, π/2]. The electrode shape is shown in FIG. 8. The electrodes have a normalized distance of one and an asymptotic thickness 1—A at a great distance from the edge which, at the end face, tapers to a vertical edge with the height $$b = 1 - A - \frac{2-2A^2}{\pi}\arctan A. \tag{3.55}$$

The parameter 0<A<1 also represents the inverse E-field overshoot as a result of the presence of the electrodes. The thickness of the electrodes can be arbitrarily small without introducing noticeable E-field distortions.

A negative curvature, e.g. at the openings along the beam path, further reduces the E-field amplitude.

This positive result can be traced back to the fact that the electrodes only cause local interference in an already existing E-field.

The optimal shape for free-standing high-voltage electrodes are ROGOWSKI- and BORDA profiles, with a peak value in the E-field amplitude of twice the undistorted field strength.

Drive Voltage Generator

The drive voltage generator must provide a high AC voltage at a high frequency. The usual procedure is to amplify an average AC voltage by a highly-insulated output transformer.

Interfering internal resonances, which are caused by unavoidable winding capacitances and leakage inductances, cause the draft of a design for such a transformer to be a challenge.

A charge pump can be an alternative thereto, i.e. a periodically operated semiconductor Marx generator. Such a circuit supplies an output voltage which alternates between ground and a high voltage of single polarity, and efficiently charges the first capacitor of the capacitor chain.

Dielectric Strength in the Vacuum $d^{-0.5}$-Law

There are a number of indications—but no final explanation—that the breakdown voltage is approximately proportional to the square root of the spacing for electrode spacings greater than $d \approx 10^{-3}$ m. The breakdown E-field therefore scales as per $$E_{max} = \sigma d^{-0.5} \tag{A.1}$$

with A constant, depending on the electrode material (see below). It appears as if currently available electrode surface materials require an electrode spacing distance of $d \leq 10^{-2}$ m for fields of E≈20 MV/m.

Surface Materials

The flashover between the electrodes in the vacuum strongly depends on the material surface. The results of the CLIC study (A. Descoeudres et al. "DC Breakdown experiments for CLIC", Proceedings of EPAC08, Genoa, Italy, p. 577, 2008) show the breakdown coefficients

| material | $\sigma \cdot \text{in.}\left[\frac{\text{MV}}{\sqrt{\text{n}}}\right]$ | |
|---|---|---|
| steel | 3.85 | |
| SS 316LN | 3.79 | 3.16 |
| Ni | 3.04 | |
| V | | 2.84 |
| Ti | | 2.70 |
| Mo | | 1.92 |
| Monel | 1.90 | |
| Ta | | 1.34 |
| Al | 1.30 | 0.45 |
| Cu | 1.17 | 0.76 |

Dependence on the Electrode Area

There are indications that the electrode surface has a substantial influence on the breakdown field strength. Thus:

$$E_{max} \approx 58 \cdot 10^6 \frac{V}{m}\left(\frac{A_{off}}{1\ \text{cm}^2}\right)^{-0.25} \tag{A.2}$$

applies for copper electrode surfaces and an electrode spacing of $2*10^{-2}$ mm. The following applies to planar electrodes made of stainless steel with a spacing of $10^{-3}$ m:

$$E_{max} \approx 57.38 \cdot 10^6 \frac{V}{m}\left(\frac{A_{off}}{1\ \text{cm}^2}\right)^{-0.12} \tag{A.3}$$

Shape of the Electrostatic Field

Dielectric Utilization Rate

It is generally accepted that homogeneous E-fields permit the greatest voltages. The dielectric SCHWAIGER utilization rate factor $\eta$ is defined as the inverse of the local E-field overshoot as a result of field inhomogeneities, i.e. the ratio of the E-field in an ideal flat electrode arrangement and the peak-surface E-field of the geometry when considering the same reference voltages and distances.

It represents the utilization of the dielectric with respect to E-field amplitudes. For small distances $d<6*10^{-3}$ m, inhomogeneous E-fields appear to increase the breakdown voltage.

Curvature of the Electrode Surface

Since the E-field inhomogeneity maxima occur at the electrode surfaces, the relevant measure for the electrode shape is the mean curvature H=(k1+k2)/2.

There are different surfaces which satisfy the ideal of vanishing, local mean curvatures over large areas. By way of example, this includes catenary rotational surfaces with H=0.

Each purely geometrical measure such as $\eta$ or H can only represent an approximation to the actual breakdown behavior. Local E-field inhomogeneities have a non-local influence on the breakdown limit and can even improve the general overall field strength.

Constant E-Field Electrode Surfaces

FIG. 8 shows KIRCHHOFF electrode edges in the case of A=0.6 for a vertical E-field. The field increase within the electrode stack is $1/A=1.\overline{6}$. The end faces are flat.

An electrode surface represents an equipotential line of the electric field analogous to a free surface of a flowing liquid. A voltage-free electrode follows the flow field line. Any analytical function w(z) with the complex spatial coordinate z=x+iy satisfies the POISSON equation. The boundary condition for the free flow area is equivalent to a constant magnitude of the (conjugated) derivative v of a possible function w $$\overline{v} = \frac{dw}{dz}. \tag{A.4}$$

Any possible function $w(\overline{v})$ over a flow velocity $\overline{v}$ or a hodograph plane leads to a z-imaging of the plane $$z = \int \frac{dw}{\overline{v}} = \int \frac{1}{\overline{v}}\frac{dw}{d\overline{v}}d\overline{v}. \tag{A.5}$$

Without loss of generality, the magnitude of the derivative on the electrode surface can be normalized to one, and the height DE can be denoted as A compared to AF (see FIG. 6). In the $\overline{v}$-plane the curve CD then images on the arc $i \rightarrow 1$ on the unit circle.

In FIG. 8, points A and F correspond to 1/A, B corresponds to the origin, C corresponds to i and D and E correspond to 1.

The complete flow pattern is imaged in the first quadrant of the unit circle. The source of the flow lines is 1/A, that of the sink is 1.

Two reflections on the imaginary axis and the unit circle extend this flow pattern over the entire complex $\overline{v}$-plane. The potential function $\omega$ is therefore defined by four sources at $\overline{v}$-positions +A, −A, 1/A, −1/A and two sinks of strength 2 at ±1.

$$\omega = \log(\overline{v} - A) + \log(\overline{v} + A) + \log\left(\overline{v} - \frac{1}{A}\right) + \log\left(\overline{v} + \frac{1}{A}\right) - 2\log(\overline{v} - 1) - 2\log(\overline{v} + 1). \tag{A.6}$$

The derivative thereof is $$\frac{dw}{d\overline{v}} = \frac{1}{\overline{v} - A} + \frac{1}{\overline{v} + A} + \frac{1}{\overline{v} - \frac{1}{A}} + \frac{1}{\overline{v} + \frac{1}{A}} - \frac{2}{\overline{v} - 1} - \frac{2}{\overline{v} + 1} \tag{A.7}$$

and thus $$z - z_0 = \int \frac{1}{\overline{v}}\left(\frac{1}{\overline{v} - A} + \frac{1}{\overline{v} + A} + \frac{1}{\overline{v} - \frac{1}{A}} + \frac{1}{\overline{v} + \frac{1}{A}} - \frac{2}{\overline{v} - 1} - \frac{2}{\overline{v} + 1}\right)d\overline{v} \tag{A.8}$$

At the free boundary CD, the flow velocity is $\overline{v}=e^{i\Phi}$, hence $d\overline{v}=i\overline{v}d\phi$ and $$z - z_0 = \int_{-\frac{\pi}{2}}^{-\theta} \frac{i}{e^{i\varphi} - A} + \frac{i}{e^{i\varphi} + A} + \frac{i}{e^{i\varphi} - \frac{1}{A}} + \frac{i}{e^{i\varphi} + \frac{1}{A}} - \frac{2i}{e^{i\varphi} - 1} - \frac{2i}{e^{i\varphi} + 1}d\varphi \tag{A.9}$$

with $z_0$=i b at point C. Analytic integration provides equation (3.54).

LIST OF REFERENCE SIGNS

| | |
|---|---|
| 9 | High-voltage cascade |
| 11 | Input |
| 13 | Diode |

-continued

| | |
|---|---|
| 15 | Capacitor |
| 17 | Capacitor |
| 19 | Diode |
| 21 | Output |
| 23 | First set of capacitors |
| 25 | Second set of capacitors |
| 31 | High-voltage source |
| 33 | Intermediate electrode |
| 35 | High-voltage cascade |
| 37 | Central electrode |
| 39 | Outer electrode |
| 39', 39" | Electrode shell half |
| 41 | First capacitor chain |
| 43 | Second capacitor chain |
| 45 | AC voltage source |
| 47 | Equatorial cut |
| 49 | Diode |
| 51 | Acceleration channel through the second capacitor chain |
| 52 | Particle source |
| 61 | Tandem accelerator |
| 53 | Acceleration channel through the first capacitor chain |
| 55 | Carbon film |
| 63 | Electron tubes |
| 65 | Cathode |
| 67 | Anode |
| 81 | High-voltage source |

What is claimed is:

1. A DC high-voltage source for providing DC voltage, comprising:

a capacitor stack comprising:

a first electrode configured to be brought to a first potential, a second electrode concentrically arranged with respect to the first electrode and configured to be brought to a second potential that differs from the first potential, and a plurality of intermediate electrodes concentrically arranged with respect to one another and concentrically arranged between the first electrode and the second electrode, wherein the plurality of intermediate electrodes are configured to be brought to a sequence of increasing potential levels between the first potential and the second potential, a switching device, to which the electrodes of the capacitor stack are connected and which is configured such that, during operation of the switching device, the electrodes of the capacitor stack concentrically arranged with respect to one another can be brought to increasing potential levels, wherein the spacing of the electrodes of the capacitor stack reduces toward the central electrode.

2. The DC high-voltage source of claim 1, wherein the switching device is embodied such that the electrodes of the capacitor stack can be charged from the outside, more particularly via the outermost electrode, with the aid of a pump AC voltage and thereby be brought to the increasing potential levels.

3. The DC high-voltage source of claim 1, wherein the spacing of the electrodes, which decreases toward the central electrode of the capacitor stack is selected such that a substantially unchanging field strength forms between adjacent electrodes.

4. The DC high-voltage source of claim 1, wherein the switching device comprises a high-voltage cascade, more particularly a Greinacher cascade or a Cockcroft-Walton cascade.

5. The DC high-voltage source of claim 1, wherein the capacitor stack is subdivided into two mutually separate capacitor chains by a gap which runs through the electrodes.

6. The DC high-voltage source of claim 5, wherein the switching device comprises a high-voltage cascade, which interconnects the two mutually separated capacitor chains and which, in particular, is arranged in the gap.

7. The DC high-voltage source of claim 6, wherein the high-voltage cascade is a Greinacher cascade or a Cockcroft-Walton cascade.

8. The DC high-voltage source of claim 1, wherein the switching device comprises diodes.

9. The DC high-voltage source of claim 1, wherein the electrodes of the capacitor stack are formed such that they are situated on the surface of an ellipsoid or on the surface of a cylinder.

10. The DC high-voltage source of claim 1, wherein the central electrode is embedded in solid or liquid insulation material.

11. The DC high-voltage source of claim 1, wherein the central electrode is insulated by a high vacuum.

12. An accelerator for accelerating charged particles, comprising:

a DC high-voltage source for providing DC voltage, comprising:

a capacitor stack comprising:

a first electrode configured to be brought to a first potential, a second electrode concentrically arranged with respect to the first electrode and configured to be brought to a second potential that differs from the first potential, and a plurality of intermediate electrodes concentrically arranged with respect to one another and concentrically arranged between the first electrode and the second electrode, wherein the plurality of intermediate electrodes are configured to be brought to a sequence of increasing potential levels between the first potential and the second potential, a switching device, to which the electrodes of the capacitor stack are connected and which is configured such that, during operation of the switching device, the electrodes of the capacitor stack concentrically arranged with respect to one another can be brought to increasing potential levels, wherein the spacing of the electrodes of the capacitor stack reduces toward the central electrode, and an acceleration channel formed by openings in the electrodes of the capacitor stack such that charged particles can be accelerated through the acceleration channel.

13. The accelerator as claimed in claim 12, wherein the particle source is arranged within the central electrode.

14. The accelerator of claim 12, wherein the switching device is embodied such that the electrodes of the capacitor stack can be charged from the outside, more particularly via the outermost electrode, with the aid of a pump AC voltage and thereby be brought to the increasing potential levels.

15. The accelerator of claim 12, wherein the spacing of the electrodes, which decreases toward the central electrode of the capacitor stack is selected such that a substantially unchanging field strength forms between adjacent electrodes.

16. The accelerator of claim 12, wherein the switching device comprises a high-voltage cascade, more particularly a Greinacher cascade or a Cockcroft-Walton cascade.

17. The accelerator of claim 12, wherein the capacitor stack is subdivided into two mutually separate capacitor chains by a gap which runs through the electrodes.

18. The accelerator of claim 16, wherein the switching device comprises a high-voltage cascade, which interconnects the two mutually separated capacitor chains and which, in particular, is arranged in the gap.

19. The accelerator of claim 17, wherein the high-voltage cascade is a Greinacher cascade or a Cockcroft-Walton cascade.

20. The accelerator of claim 12, wherein the electrodes of the capacitor stack are formed such that they are situated on the surface of an ellipsoid or on the surface of a cylinder.

* * * * *